US007905529B2

(12) United States Patent
Reed et al.

(10) Patent No.: US 7,905,529 B2
(45) Date of Patent: Mar. 15, 2011

(54) RISER LIFTING TOOL

(75) Inventors: H. Wade Reed, DeSoto, TX (US); E. Martin Klatt, Southlake, TX (US); Donald E. Mullins, Houston, TX (US)

(73) Assignee: Hannon Hydraulics GP, LLC, Irving, TX (US)

( * ) Notice: Subject to any disclaimer, the term of this patent is extended or adjusted under 35 U.S.C. 154(b) by 339 days.

(21) Appl. No.: 12/207,654

(22) Filed: Sep. 10, 2008

(65) Prior Publication Data

US 2010/0061827 A1 Mar. 11, 2010

(51) Int. Cl.
*B66C 1/62* (2006.01)

(52) U.S. Cl. ..... 294/86.4; 294/82.35; 294/103.1

(58) Field of Classification Search ..... 294/86.4, 294/103.1, 119.1, 119.2, 82.1, 82.17, 82.23, 294/82.31, 82.35; 414/22.51, 626
See application file for complete search history.

(56) References Cited

U.S. PATENT DOCUMENTS

| | | | | | |
|---|---|---|---|---|---|
| 1,392,260 | A | * | 9/1921 | Schollar | 294/82.24 |
| 1,518,662 | A | * | 12/1924 | McKamey et al. | 294/82.31 |
| 3,472,401 | A | * | 10/1969 | Scaperotto | 414/734 |
| 3,883,170 | A | * | 5/1975 | Fricker et al. | 294/82.35 |
| 3,964,777 | A | * | 6/1976 | Lindqvist | 294/82.3 |
| 4,030,746 | A | * | 6/1977 | Langowski | 294/88 |
| 4,202,653 | A | | 5/1980 | Moller | |
| 4,360,230 | A | * | 11/1982 | Wood et al. | 294/90 |
| 4,808,034 | A | | 2/1989 | Birch | |
| 5,244,243 | A | * | 9/1993 | Grayson et al. | 294/89 |
| 5,284,374 | A | * | 2/1994 | Szkrybalo et al. | 294/86.4 |
| 6,719,497 | B1 | * | 4/2004 | Pollack et al. | 405/224 |
| 6,877,281 | B1 | | 4/2005 | Gavin | |

* cited by examiner

*Primary Examiner* — Dean J Kramer
(74) *Attorney, Agent, or Firm* — Browning Bushman P.C.

(57) ABSTRACT

A lifting tool (10) is provided for supporting an oilfield riser during relocation by a crane having a support line (14). The tool body (12) has an inverted U-shaped configuration with a central opening (18) and a downwardly facing throat (20). A powered drive (26) rotates the arcuate member between the open position and the closed position.

17 Claims, 3 Drawing Sheets

RISER LIFTING TOOL

FIELD OF THE INVENTION

The present invention relates to tools for supporting an oilfield riser during relocation on a rig. More particularly, this invention relates to an improved tool which reliably engages and manipulates an oilfield riser while reducing the risk of personal injury or damage to the riser.

BACKGROUND OF THE INVENTION

Oilfield risers are conventionally used in offshore oil drilling operations, and comprise pipe sections intended to surround and isolate casing from the sea water. During makeup and breakout of the riser string, the individual riser sections are generally stacked on the rig floor and are repositioned between a riser storage area and a staging area. Risers typically have one or more fluid conduits or cables exterior of the riser, which complicates the riser handling operation.

U.S. Pat. No. 4,202,653 discloses a pipe handling system including a bridge crane. U.S. Pat. No. 4,808,034 discloses a riser with a ring guide for positioning the riser. U.S. Pat. No. 6,877,281 discloses a stackable riser with a riser cover. None of the above prior art provides an effective system for safely and reliably positioning a riser on a rig between a storage area and a staging area.

Individual riser sections are commonly moved from a staging area to a storage area by a crane. More particularly, a scissors-type tool is conventionally suspended from the crane and is used to grab the riser for manipulation by the crane. In many applications, however, the scissors tool cannot reliably grasp a stacked riser section, and accordingly another initial manipulation mechanism is provided for initially positioning the riser from the stack so it may be subsequently grabbed by the scissors tool. In some cases, this initial manipulation is accomplished by a smaller crane and a series of straps which may be passed under the riser and connected to the smaller crane. Considerable time and expense are involved in using two such cranes to manipulate the riser, and the reliability of the system is a function of the number and correct positioning of the straps, and also the reliability of a scissors-type tool which is merely grasping opposing sides of the riser section.

The disadvantages of the prior art are overcome by the present invention, and an improved lifting tool for supporting an offshore riser during manipulation on a rig is hereinafter disclosed.

SUMMARY OF THE INVENTION

A lifting tool is provided for supporting an oilfield riser during the relocation by a crane having a support line. In one embodiment, a tool body is suspended from the support line and has an inverted U-shaped configuration, a central opening for receiving the riser, and a downwardly facing throat. An arcuate member is supported on the tool body and is rotated about a central axis between an open position wherein a spacing arcuate member is circumferentially aligned with the open throat, and a closed position wherein the arcuate member at least substantially closes the open throat. A powered drive is provided for rotating the arcuate member between the open position and the closed position.

One embodiment of the method of supporting an oilfield riser during relocation on a rig comprises suspending a tool body from the support line and with the tool body having an inverted U-shaped configuration, a central opening for receiving the riser, and downwardly facing throat. An arcuate member is supported on the tool body and is rotated about a central axis between an open position and a closed position. In the closed position, the arcuate member substantially closes the open throat such that the arcuate member supports the riser when positioned within the central opening of the tool body when the tool is raised.

These and further features and advantages of the present invention will become apparent from the following detailed description, wherein reference is made to the figures in the accompanying drawings.

DETAILED DESCRIPTION OF PREFERRED EMBODIMENTS

Figure 1:
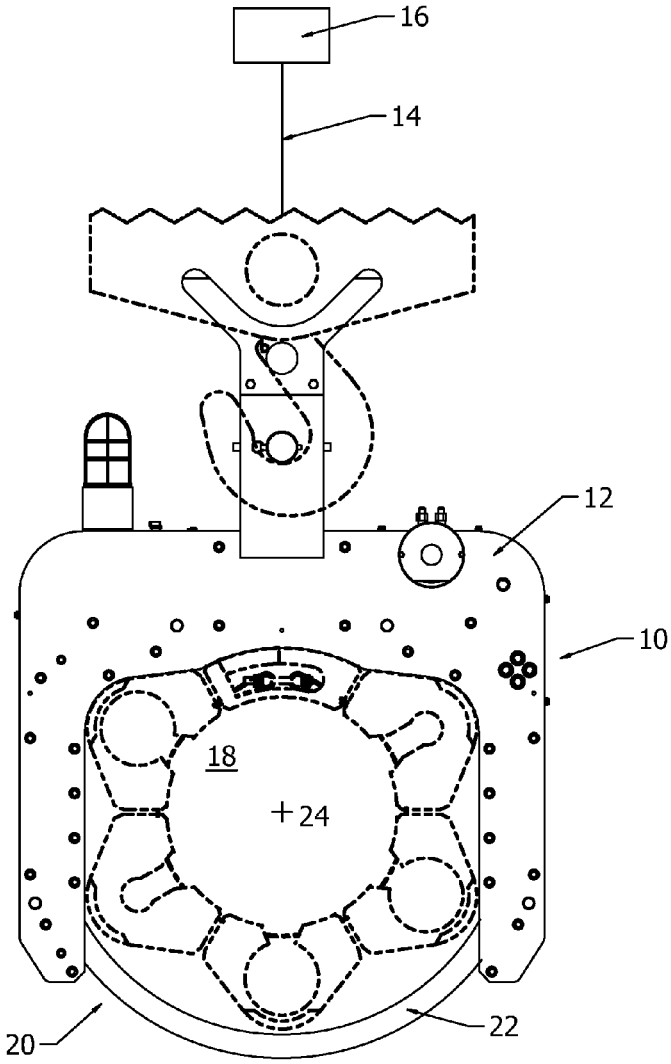
FIG. 1 is a side view of a lifting tool supported from a crane support line.

FIG. 1 discloses a lifting tool 10 according to one embodiment of the invention. The tool 10 includes a tool body 12 for suspending from the support line 14 of a crane 16. As shown in FIG. 1, the tool body has an inverted U-shaped configuration, with a central opening 18 for receiving the riser therein, and a downwardly facing open throat 20, which allows the tool to be lowered over a riser section. The tool body also includes an arcuate member 22 which is supported on the tool body and is rotatable about a central axis 24. The arcuate member 22 is shown in FIG. 1 in the closed position, such that the arcuate member at least substantially closes the open throat and the arcuate member supports the riser when positioned within the central opening 18 of the tool body when the tool and riser section are raised by the support line 14. In a preferred embodiment, the closed arcuate member fully closes off the open throat in the tool body. Also, the circumferential width of the spacing in the arcuate member is substantially equal to the circumferential spacing of the open throat, thereby maximizing the holding ability of the closed arcuate member to support the riser.

Figure 3:
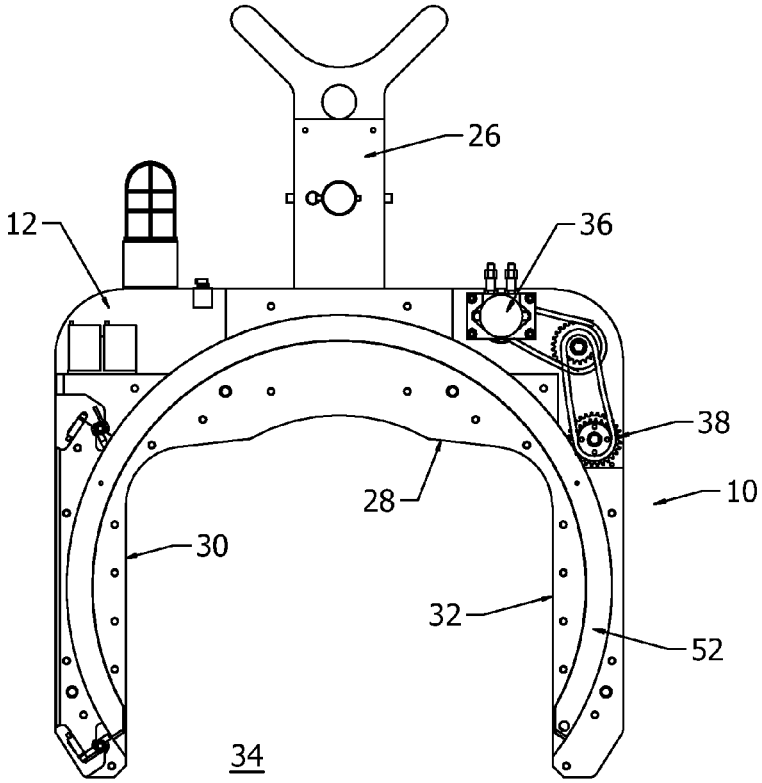
FIG. 3 is a side view of a portion of the lifting device wherein some of the tool components are removed for clarity of the remaining components.
Figure 4:
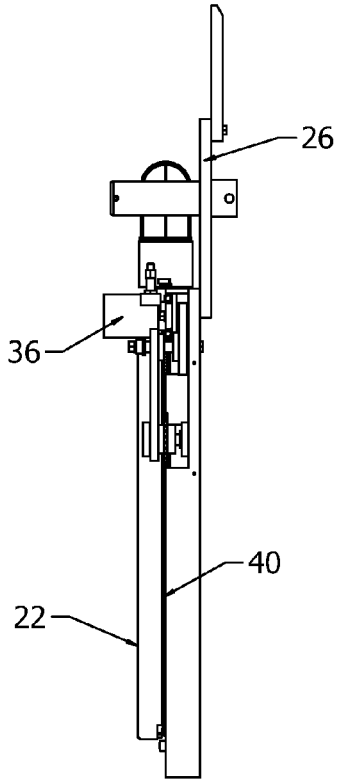
FIG. 4 is a side view of the device shown in FIG. 3.
Figure 5:
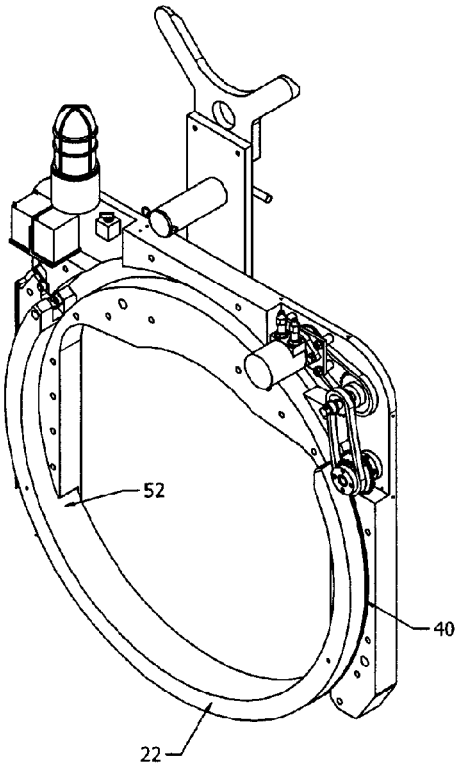
FIG. 5 is a pictorial view of a portion of the lifting device, including its functional components.
Figure 6:
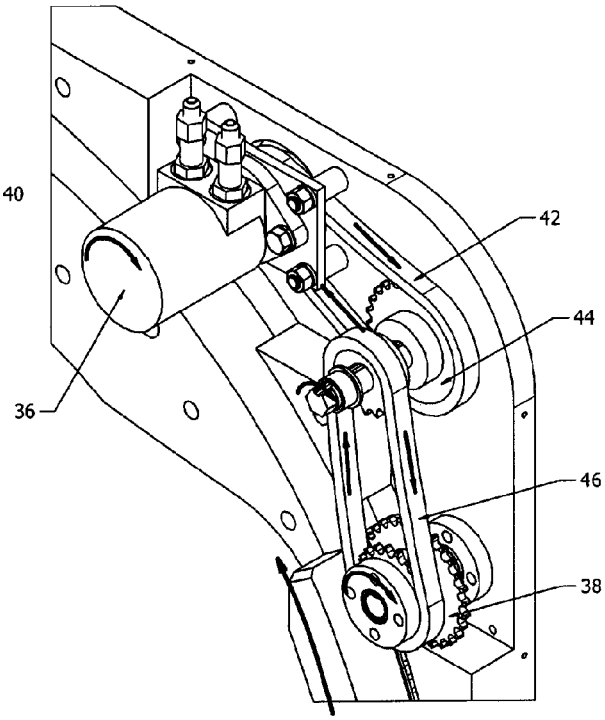
FIG. 6 is an expanded view of a portion of the device shown in FIG. 5.

Referring briefly to FIG. 3, a Y-shaped hangar 26 is shown connected to the tool body 12. The upper interior surface 28 of the tool body and the side surfaces 30, 32 are configured for accepting a particular type of riser with a known quantity and configuration of external flow lines. The tool body 12 may thus be modified for different size risers and risers with different flow line configurations. FIGS. 3 and 4 illustrate a drive motor 36 powering a drive sprocket 38, wherein more chains or belts and an optional intermediate sprocket are used between the drive motor 36 and the sprocket 38. Returning briefly to FIG. 4, a chain 40 is mounted to the radially exterior surface of the arcuate member 22, and is driven by the rotating sprocket 38 to rotate the arcuate member between the open position as shown in FIG. 3 and the closed position as shown in FIG. 5. Alternatively, teeth may be formed directly on the arcuate member, or another type of powered drive may be used to rotate the arcuate member.

While a preferred embodiment of the tool utilizes the tool body itself to slidably engage the arcuate member and thereby control rotation of the arcuate member, one or more bearings may be provided along the travel path of the arcuate member for engaging and guiding the arcuate member during rotation, thereby minimizing friction.

FIG. 5 discloses in further detail the drive 36 which conveniently may be a hydraulically powered drive motor which rotates drive belt 42 and thereby rotates sprocket 44, which in turn rotates about the drive belt 46 which rotates sprocket 38, which engages the chain 40 and thereby drives the arcuate member 22.

Figure 2:
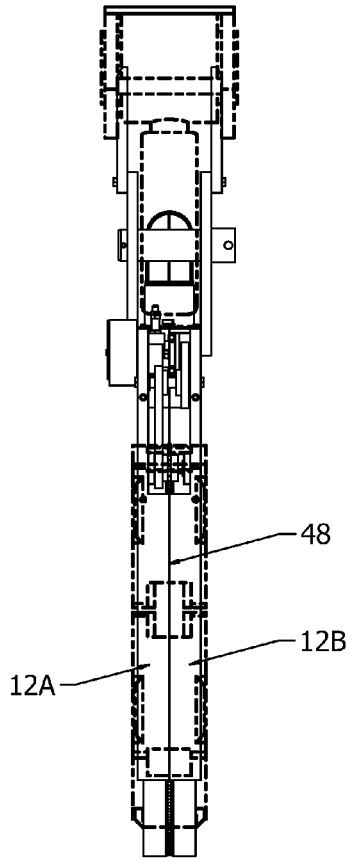
FIG. 2 is a side view of a lifting tool shown in FIG. 1.

Referring now to FIG. 2, the tool body may be manufactured in two halves, with a body centerline through the central plane 48. Body segments 12A, 12B of the tool body thus guide the arcuate member 22 during rotation, with the arcuate member being positioned in an arcuate groove on each half 12A, 12B. FIG. 3 illustrates an arcuate slot 52 in one half of the tool body, while FIG. 5 illustrates half of the arcuate member 32 positioned within arcuate slot 52 on half the tool body.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A lifting tool for supporting an oilfield riser during relocation by crane having a support line, comprising:

a tool body for suspending from the support line and having an inverted U-shaped configuration, with a central opening for receiving the riser and a downwardly facing throat;

an arcuate member supported on the tool body and rotatable about a central axis, the arcuate member having an open position wherein a spacing in the arcuate member is circumferentially aligned with the open throat of the tool body, and the arcuate member having a closed position wherein the arcuate member at least substantially closes the open throat such that the arcuate member supports the riser when positioned within the central opening of the tool body when the tool is raised by the support line; and a powered drive for rotating the arcuate member between the open position and the closed position; and a drive chain secured to an exterior surface of the arcuate member for rotatably driving the arcuate member.

2. A lifting tool as defined in claim 1, wherein the arcuate member is rotatably guided by the tool body during rotation.

3. A lifting tool as defined in claim 2, wherein the tool body is formed in two halves, each half having an arcuate groove for receiving a portion of the arcuate member.

4. A lifting tool as defined in claim 1, further comprising:

a rotatable gear powered by the drive motor for engaging the drive chain.

5. A lifting tool as defined in claim 1, wherein the drive motor is hydraulically powered.

6. A lifting tool as defined in claim 1, wherein the arcuate member closes off the open throat when the arcuate member is in the closed position.

7. A lifting tool as defined in claim 1, wherein the circumferential width of the spacing in the arcuate member is substantially equal to the circumferential width of the open throat.

8. A lifting tool as defined in claim 1, wherein side walls of the central opening in the tool body are configured for accepting the riser therein.

9. A lifting tool for supporting an oilfield riser during relocation by crane having a support line, comprising:

a tool body for suspending from the support line and having an inverted U-shaped configuration, with a central opening for receiving the riser and a downwardly facing throat;

an arcuate member supported on the tool body and rotatable about a central axis, the arcuate member having an open position wherein a spacing in the arcuate member is circumferentially aligned with the open throat of the tool body, and the arcuate member having a closed position wherein the arcuate member closes the open throat such that the arcuate member supports the riser when positioned within the central opening of the tool body when the tool is raised by the support line, a circumferential width of the spacing in the arcuate member being substantially equal to the circumferential width of the open throat;

a powered drive for rotating the arcuate member between the open position and the closed position; and a drive chain secured to an exterior surface of the arcuate member for rotatably driving the arcuate member.

10. A lifting tool as defined in claim 9, wherein the tool body is formed in two halves, each half having an arcuate groove for receiving a portion of the arcuate member.

11. A lifting tool as defined in claim 9, wherein side walls of the central opening in the tool body are configured for accepting the riser therein.

12. A method of supporting an oilfield riser during relocation by crane having a support line, comprising:

suspending a tool body from the support line, the tool body having an inverted U-shaped configuration, with a central opening for receiving the riser and a downwardly facing throat;

supporting an arcuate member on the tool body and rotatable about a central axis, the arcuate member having an open position wherein a spacing in the arcuate member is circumferentially aligned with the open throat of the tool body, and the arcuate member having a closed position wherein the arcuate member at least substantially closes the open throat such that the arcuate member supports the riser when positioned within the central opening of the tool body when the tool is raised by the support line; and powering a drive for rotating the arcuate member between the open position and the closed position; and securing a drive chain to an exterior surface of the arcuate member for rotatably driving the arcuate member.

13. A method as defined in claim 12, wherein the arcuate member is rotatably guided by the tool body during rotation.

14. A method as defined in claim 13, wherein the tool body is formed in two halves, each half having an arcuate groove for receiving a portion of the arcuate member.

15. A method as defined in claim 12, further comprising:

rotatably supporting a gear powered by the drive motor for engaging the chain.

16. A method as defined in claim 12, wherein the circumferential width of the spacing in the arcuate member is substantially equal to the circumferential width of the open throat.

17. A method as defined in claim 12, wherein side walls of the central opening in the tool body are configured for accepting the riser therein.

* * * * *

UNITED STATES PATENT AND TRADEMARK OFFICE

CERTIFICATE OF CORRECTION

PATENT NO. : 7,905,529 B2
APPLICATION NO. : 12/207654
DATED : March 15, 2011
INVENTOR(S) : Reed et al.

It is certified that error appears in the above-identified patent and that said Letters Patent is hereby corrected as shown below:

Column 3:
Line 38, please remove the word “and”.

Column 4:
Line 42, please remove the word “and”.

Signed and Sealed this
Nineteenth Day of April, 2011

David J. Kappos

David J. Kappos
*Director of the United States Patent and Trademark Office*